US005313807A

United States Patent [19]

Owen

[11] Patent Number: 5,313,807

[45] Date of Patent: May 24, 1994

[54] INSULATED HOLDER WITH COOLER POCKET

[76] Inventor: Michelle L. Owen, 5091 Hot Wells Rd., Boyce, La. 71409

[21] Appl. No.: 47,267

[22] Filed: Apr. 12, 1993

[51] Int. Cl.[5] ..... F25D 3/08

[52] U.S. Cl. ..... 62/457.3; 62/530; 62/372

[58] Field of Search ..... 62/372, 457.2, 457.3, 62/457.4, 457.5, 529, 530; 220/411, 412, 413, 739; 215/13.1, 12.1

[56] References Cited

U.S. PATENT DOCUMENTS

| | | | |
|---|---|---|---|
| D. 281,546 | 12/1985 | Bradshaw | D3/53 |
| D. 315,477 | 3/1991 | Shearer | D7/607 |
| 1,687,004 | 10/1928 | Briggs | 215/11.6 |
| 1,939,777 | 12/1933 | Humboltd | 215/12.1 |
| 2,464,069 | 3/1949 | Benson | 215/12.1 |
| 2,522,381 | 9/1950 | Kramer | 215/11.6 |
| 4,197,890 | 4/1980 | Simko | 62/372 |
| 4,514,993 | 5/1985 | Johnson | 62/372 |
| 5,005,374 | 4/1991 | Spitler | 62/457.2 |

*Primary Examiner*—John M. Sollecito
*Attorney, Agent, or Firm*—John M. Harrison

[57] ABSTRACT

An insulated bottle container which is characterized by a flexible enclosure having an inner insulation layer and a stiff bottom to facilitate freestanding and shock resistance. Elastic is provided in the neck and body portions of the enclosure to ensure a tight fit around a bottle, can or other container placed in the enclosure. At least one, and preferably a pair of refrigerant pockets are provided in the body of the enclosure to receive refrigerant capsules that may be frozen to provide cooling of the bottle, can or other container in the enclosure. One or more handles may be attached to the top portion of the enclosure for carrying purposes.

16 Claims, 1 Drawing Sheet

INSULATED HOLDER WITH COOLER POCKET

BACKGROUND OF THE INVENTION

Field of the Invention

This invention relates to insulated containers and more particularly, to an insulated container adapted to contain bottles, cans and other containers and maintain the contents of the containers in a cool condition. In a preferred embodiment the insulated container is characterized by an enclosure constructed of a flexible, resilient material such as "rip-stop" nylon provided with a flexible insulation inner liner and a stiff enclosure bottom to facilitate freestanding and shock resistance. An elastic neck closure and an elastic size adjustment band are provided in the enclosure to facilitate a tight fit on the contained bottle, can or alternative container. One or more handles can be attached to the top of the enclosure for carrying purposes and at least one, and preferably two or more refrigerant pockets are provided in the body of the enclosure for receiving refrigerant containers containing encapsulated refrigerant that may be frozen to maintain the contents of the insulated container in a cool condition. In a most preferred embodiment tile refrigerant containers are fitted in-to corresponding refrigerant pockets by releasing loop-pile closure elements provided at the tops of the refrigerant pockets to maintain the refrigerant containers inside the pockets.

One of the problems associated with maintaining baby bottles, as well as food and beverage containers of any description in a cool condition after removal from a refrigerator or ice chest, is that of rapid heating of the container contents, sometimes causing spoilage. This is particularly undesirable in the case of formula or milk placed in baby bottles because of the delicate nature of infants and the necessity of frequently feeding them on a regular basis. Accordingly, the solution to the problem usually takes the form of large, bulky insulated containers which are capable of carrying ice or frozen refrigerant capsules that add to the weight and bulk that must be carried on outings, particularly involving infants. A need therefore exists for a small, compact, efficient, light-weight insulated container for maintaining individual bottles, cans and other food and beverage containers in a cool condition.

Description of the Prior Art

Various types of insulators are well known in the art. An "Insulated Bag" is detailed in Design Pat. No. 281,546, dated Dec. 3, 1985, to Charlotte S. Bradshaw. The insulated bag includes a body portion having a pair of upward-standing handles and a closure at the top for receiving cold or hot food or beverages and maintaining the food or beverages in a hot or cold condition, as desired. U.S. Pat. No. 315,477, dated Mar. 19, 1991, to Michael W. Shearer, details a "Refrigerated Totebag". The refrigerated totebag is characterized by a flexible, resilient body portion having a drawstring at the top thereof for tightening around a bottle and a handle built into the side portion of the body for carrying purposes. U.S. Pat. No. 1,687,004, dated Oct. 9, 1928, to M. Briggs, details a "Nursing Bottle Cover and Nipple Support", which is characterized by an insulating sleeve fitted with multiple side strips constructed of cardboard or other semi-flexible, non-heat conducting material for receiving a nursing bottle and maintaining the contents of the bottle in a cool condition. A drawstring is provided at the neck of the cover for tightening around the neck of the bottle. U.S. Pat. No. 1,939,777, dated Dec. 19, 1933, to A. L. Humboldt, details a "Bottle Protector and Heat Insulator". The Humboldt device is characterized by a cork-filled sleeve fitted with a drawstring at the neck for receiving a bottle and maintaining the contents of the bottle in a cool condition. A "Bottle Carrier" is detailed in U.S. Pat. No. 2,464,069, dated Mar. 8, 1949, to R. G. Benson. The Benson bottle carrier is characterized by an outer flexible, resilient covering fitted with an inner liner constructed of rubber for receiving a bottle and maintaining the contents of the bottle in a hot or cold condition. Straps are provided on the outer surface of the cover for attachment of a pair of handles and carrying the bottle carrier. A "Temperature Retaining Cover for Baby Bottles and Other Receptacles" is detailed in U.S. Pat. No. 2,522,381, dated Sept. 12, 1950, to W. Kramer. The cover includes a flexible, resilient body portion having drawstrings at the top for tightening around the neck of a baby bottle with inner and intermediate envelopes provided to act as insulation for the cover.

It is an object of this invention to provide a new and improved insulated container for bottles, cans and other food, beverage and milk containers, which container includes a flexible, resilient enclosure having an inner insulation sleeve or layer and provided with a pair of spaced elastic closures for tightening against the bottle, can or container and at least one pocket for receiving a frozen refrigerant capsule and maintaining the contents of the bottle, can or alternative container in a cool condition.

Another object of this invention is to provide a new and improved flexible, resilient insulated container fitted with spaced elastic adjustment bands, a substantially solid bottom portion to facilitate free standing of the container and insulation against shock and at least one pair of pockets provided in the enclosure for receiving frozen refrigerant capsules and maintaining the contents of the insulated container in a cool condition.

A still further object of this invention is to provide an insulated container for baby bottles, beverage cans and bottles and other containers, including paper or plastic juice containers having various shapes, which insulated containers are characterized by a flexible enclosure shaped substantially in the configuration of the bottle, can or alternative container, a pair of elastic size adjustment members provided in the enclosure and an insulation layer lining the enclosure, along with at least one pocket provided in the enclosure and extending through the insulation layer for receiving a refrigerant capsule containing frozen refrigerant and keeping the contents of the container cool.

SUMMARY OF THE INVENTION

These and other objects of the invention are provided in an insulated container characterized by a flexible, resilient enclosure of selected size and shape and having an insulated inner wall, a substantially rigid base to facilitate free standing and shock resistance of the enclosure contents, a pair of elastic bands provided in the neck and body, respectively, of the enclosure for tightening on an enclosed bottle, can or alternative container, at least one handle attached to the enclosure for carrying the insulated container and at least one pair of pockets fitted with "Velcro" pocket closures for containing frozen refrigerant capsules and maintaining the contents of the insulated container in a cool condition.

BRIEF DESCRIPTION OF THE DRAWING

The invention will be more particularly described with reference to the accompanying drawing, wherein.

DESCRIPTION OF THE PREFERRED EMBODIMENTS

Figure 1:
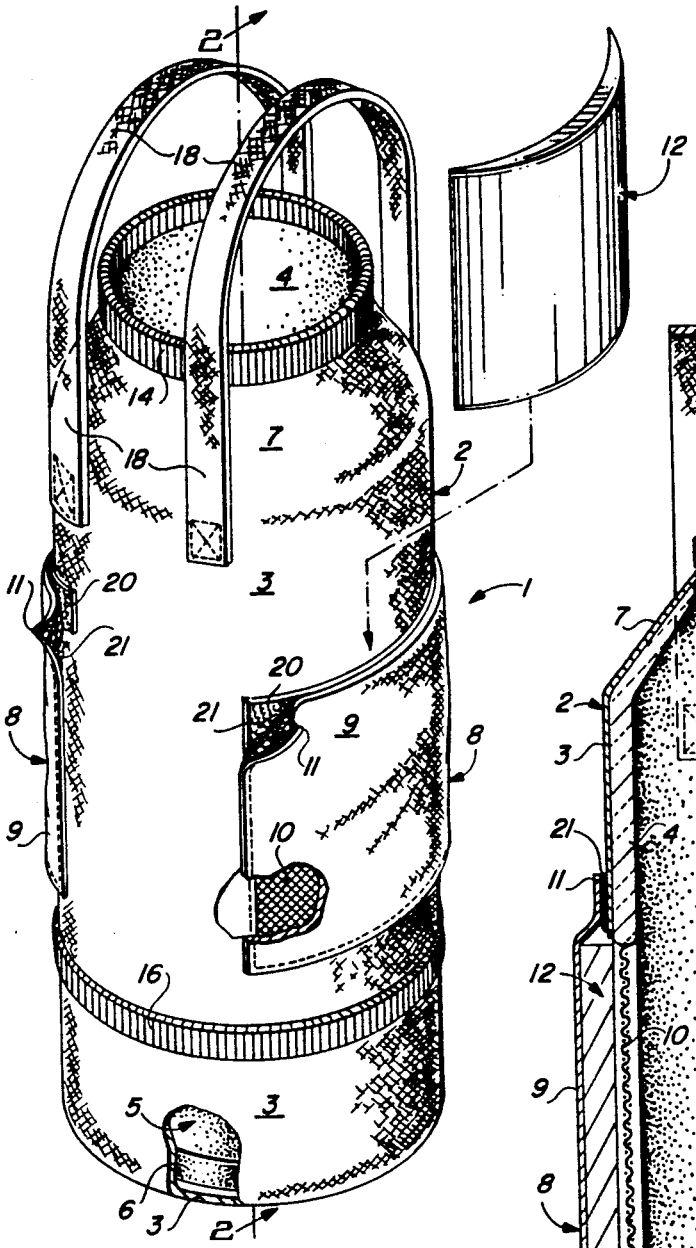
FIG. 1 is a perspective view, partially in section, of a preferred embodiment of the insulated holder of this invention.
Figure 2:
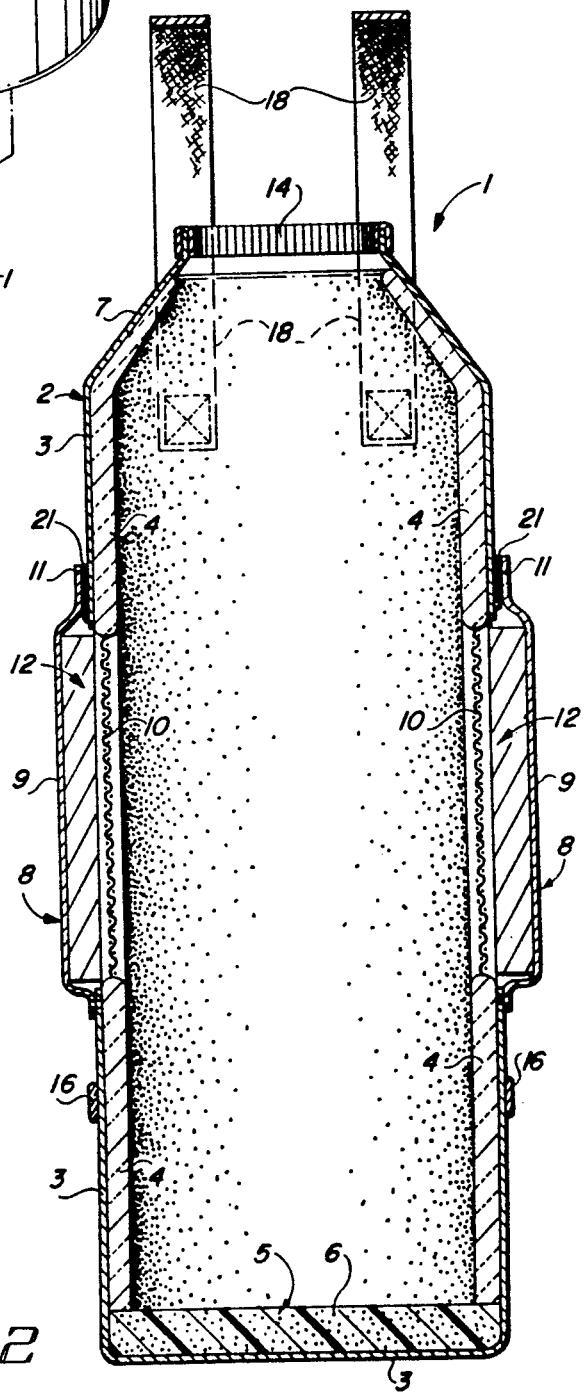
FIG. 2 is a sectional view taken along line 2-2 of the insulated holder illustrated in FIG. 1.

Referring to FIGS. 1 and 2 of the drawing, the insulated container of this invention is generally illustrated by reference numeral 1. In a most preferred embodiment the insulated container 1 is characterized by a cylindrical outer enclosure 2, which is constructed of a flexible, resilient material such as "rip stop" nylon or the like, forming an enclosure wall 3 of minimal thickness. The enclosure 2 is further fitted with an inner layer of preferably flexible, resilient insulation 4, which may be typically "Thinsulate" or "Gore-tex" (trademarks), as desired. The enclosure 2 is additionally fitted with a relatively stiff enclosure bottom 5 of stiff insulation having a desired thickness 6, such as Styrofoam (trademark) or polyurethane, in order to render the enclosure self-supporting and facilitate impact resistance to the contents of the insulated container 1. In another preferred embodiment of the invention the enclosure 2 is characterized by an enclosure neck 7 of reduced diameter and an elastic neck closure 14 is provided at the periphery of the enclosure neck 7 in order to tightly fit around a cylindrical or polygonal bottle (not illustrated) which may be inserted in the enclosure 2. An elastic size adjustment band 16 is also provided in the enclosure wall 3 of the enclosure 2, spaced from the enclosure bottom 5 as illustrated in FIG. 1, for tightening the enclosure 2 and the flexible insulation 4 around a bottle after the bottle is inserted in the enclosure 2. A pair of refrigerant pockets 8 are sewn or otherwise attached to the enclosure wall 3 on opposite sides of the enclosure 2 as illustrated in FIGS. 1 and 2 and each include a pocket panel 9, which includes a pocket closure strip 11 at the top thereof. The pile element 21, as in the common "Velcro" (trademark) fastener, is attached to the pocket closure strip 11, while a loop element 20 is attached to the enclosure wall 3 in alignment with the pile element 21. Each of the refrigerant pockets 8 is designed to receive a plastic refrigerant capsule 12, containing a suitable refrigerant which releases its latent heat of fusion upon melting, to cool the contents of a bottle when the bottle is located in the enclosure 2. In a most preferred embodiment of the invention the refrigerant capsules 12 are slightly concave on the inwardly-facing side to accord with the approximate curvature of a cylindrical or polygonal bottle located in the enclosure 2. In another preferred embodiment of the invention a retaining panel 10, constructed of web nylon or the like, forms an inner panel of each of the refrigerant pockets 8 to prevent the refrigerant container 12 from exiting the refrigerant pockets 8 into the interior of the enclosure 2 when the enclosure 2 is empty.

Referring again to the drawings, a pair of handles 18 are secured to the enclosure 2 in spaced relationship to facilitate carrying of the insulated container 1 with a bottle in place. Alternatively, a single, centered handle 18 may be utilized for the same purpose, as desired.

It will be appreciated by those skilled in the art from a consideration of the drawings that the insulated container 1 of this invention may be shaped to accommodate a bottle, can or alternative container (not illustrated) of any desired size and shape without compromising the capability of the enclosure 2, flexible insulation 4, refrigerant pockets 8 and refrigerant capsules 12 to maintain the enclosed container in a cool condition. Accordingly, the enclosure 2 may be constructed of sufficient size and shape to accommodate cylindrical metal beverage containers having "pop top" openings in the top thereof, as well as polygonal baby bottles and square or rectangular-shaped plastic or cardboard juice containers fitted with perforated openings in the top for receiving a straw. A primary purpose of the insulated container 1 is to receive baby bottles having caps with nipples to provide cool milk, formula, juice or other beverage to infants on a regular basis without compromising the quality of the milk, formula or other liquid in the bottle. Furthermore, the size of the insulated container I may be chosen to accommodate an entire "four pack" or "six pack" of containers such as soft drinks or other beverage cans, as well as packages of wine coolers and the like, as desired.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. An insulated holder for receiving and cooling a container, comprising a flexible enclosure shaped to receive the container, at least one pocket means provided in said enclosure, refrigerant capsule means containing frozen refrigerant removably inserted in said pocket means for cooling the container and pocket closure means provided on said pocket means and outer closure means provided on said enclosure for engaging said pocket closure means and removably enclosing said refrigerant capsule means in said pocket means.

2. The insulated holder of claim 1 further comprising insulation carried by said flexible enclosure adjacent to the container for insulating the container inside said enclosure.

3. The insulated holder for claim 1 further comprising at least one opening provided in said insulation adjacent to said pocket means for accommodating said refrigerant capsule means.

4. The insulated holder for claim 1 further comprising at least one elastic means carried by said enclosure for fitting said enclosure to the container.

5. The insulated holder of claim 1 further comprising substantially stiff bottom means provided in the bottom of said enclosure for stiffening said bottom of said enclosure and rendering said enclosure substantially self-supporting.

6. The insulated holder of claim 5, further comprising insulation carried by said flexible enclosure adjacent to the container for insulating the container inside said enclosure and at least one opening provided in said insulation adjacent to said pocket means for accommodating said refrigerant capsule means.

7. The insulated holder of claim 5 further comprising at least one elastic band means carried by said enclosure for fitting said enclosure to the container.

8. The insulated holder for claim 5 further comprising:

(a) flexible insulation carried by said flexible enclosure adjacent to the container for insulating the container inside said enclosure and at least one opening provided in said flexible insulation adjacent to said pocket means for accommodating said refrigerant capsule means; and (b) at least one elastic band means carried by said enclosure for fitting said enclosure to the container.

9. The insulated holder of claim 8 wherein said pocket closure means further comprises a first attachment element of a loop-pile fastener, said outer closure means further comprises a second attachment element of the loop-pile fastener and said elastic band means further comprises a first elastic band provided in the top of said enclosure and a second elastic band provided in said enclosure in spaced relationship with respect to said first elastic band.

10. The insulated holder of claim 1 further comprising at least one handle carried by said enclosure for carrying said insulated holder.

11. The insulated holder of claim 8 further comprising at least one handle carried by said enclosure for carrying said insulated holder.

12. The insulated holder of claim 11 wherein said at least one handle comprises a pair of handles attached to said enclosure in spaced relationship and extending above said enclosure, said at least one pocket means comprises a pair of pockets provided in said enclosure in spaced relationship, said pocket closure means further comprises a first attachment element of a loop-pile fastener, said outer closure means further comprises a second attachment element of the loop-pile fastener and said elastic band means further comprises a first elastic band provided in the top of said enclosure and a second elastic band provided in said enclosure in spaced relationship with respect to said first elastic band.

13. An insulated holder for receiving and cooling a container, comprising a flexible enclosure; a neck shaped in the top of said enclosure; at least one handle carried by said enclosure for carrying said insulating holder; at least one layer of flexible insulation positioned interiorly of said flexible enclosure for contacting the container; at least two pockets provided in said enclosure and said insulation in spaced relationship; a refrigerant capsule containing frozen refrigerant removably inserted in each of said pockets for cooling the container; pocket closure means provided on each of said pockets and outer closure means provided on said enclosure adjacent to said pocket closure means for engaging said pocket closure means and removably enclosing said refrigerant capsule in said pockets, respectively; and a pair of elastic band means carried by said enclosure in spaced relationship for fitting said enclosure to the container.

14. The insulated holder of claim 13 further comprising retaining panel means carried by said insulation in said pockets for engaging said refrigerant capsule and substantially stiff bottom means provided in the bottom of said enclosure for stiffening said bottom of said enclosure and rendering said enclosure substantially self-supporting.

15. The insulated holder of claim 13 wherein said pocket closure means further comprises a first attachment element of a loop-pile fastener, said outer closure means further comprises a second attachment element of the loop-pile fastener and said elastic band means further comprises a first elastic band provided in said neck of said enclosure and a second elastic band provided in said enclosure in spaced relationship with respect to said first elastic band and further comprising substantially stiff bottom means provided in the bottom of said enclosure for stiffening said bottom of said enclosure and rendering said enclosure substantially self-supporting.

16. The insulated holder of claim 15 wherein said at least one handle comprises a pair of handles attached to said enclosure in spaced relationship and extending above said enclosure.

* * * * *